US006132202A

United States Patent [19]

Eroglu et al.

[11] Patent Number: 6,132,202

[45] Date of Patent: Oct. 17, 2000

[54] METHOD AND DEVICE FOR OPERATING A PREMIX BURNER

[75] Inventors: Adnan Eroglu, Untersiggenthal, Switzerland; Robin McMillan, Bardney, United Kingdom; Jens Policke, Wettingen, Switzerland

[73] Assignee: Asea Brown Boveri AG, Baden, Switzerland

[21] Appl. No.: 09/179,462

[22] Filed: Oct. 27, 1998

[30] Foreign Application Priority Data

Oct. 27, 1997 [EP] European Pat. Off. ..... 97810801

[51] Int. Cl.[7] ..... F23C 5/00; F23J 11/04

[52] U.S. Cl. ..... 431/8; 431/10; 431/350; 431/353; 431/4; 60/39.59; 60/39.53; 239/403; 239/405; 239/5

[58] Field of Search ..... 431/8, 3, 4, 9, 431/353, 354, 10, 350; 60/39.53, 39.55, 39.58, 39.59; 239/398, 399, 403, 601, 405, 5, 11, 434

[56] References Cited

U.S. PATENT DOCUMENTS

| | | | |
|---|---|---|---|
| 715,044 | 12/1902 | Fisher | 239/403 |
| 771,464 | 10/1904 | Cunningham | 239/399 |
| 1,369,688 | 2/1921 | Mayer | 239/405 |
| 1,450,881 | 4/1923 | Allen | 239/399 |
| 1,655,222 | 1/1928 | Elze | 239/403 |
| 2,566,040 | 8/1951 | Simmons | 239/403 |
| 2,635,009 | 4/1953 | Knight | 239/601 |
| 3,059,860 | 10/1962 | Hohn | 239/398 |
| 3,088,854 | 5/1963 | Spies, Jr. | 239/601 |
| 3,814,567 | 6/1974 | Zink et al. | 431/4 |
| 4,133,485 | 1/1979 | Bouvin | 239/399 |
| 4,214,435 | 7/1980 | Campbell | 60/39.59 |
| 4,389,848 | 6/1983 | Markowski et al. | 60/738 |
| 4,395,874 | 8/1983 | Striebel et al. | 60/39.58 |
| 4,416,610 | 11/1983 | Gallagher, Jr. | 431/4 |
| 4,893,468 | 1/1990 | Hines | 60/39.53 |
| 5,249,957 | 10/1993 | Hirata | 431/354 |
| 5,284,437 | 2/1994 | Aigner | 431/4 |
| 5,681,162 | 10/1997 | Nabors, Jr. et al. | 431/8 |
| 5,813,847 | 9/1998 | Eroglu et al. | 431/8 |
| 5,934,555 | 8/1999 | Dobbeling et al. | 239/405 |

FOREIGN PATENT DOCUMENTS

| | | | |
|---|---|---|---|
| 0321809B1 | 5/1991 | European Pat. Off. . | |
| 0483554A1 | 5/1992 | European Pat. Off. . | |
| 2454837 | 11/1980 | France . | |
| 2547020 | 12/1984 | France . | |
| 257016 | 2/1913 | Germany | 239/405 |
| 4306956A1 | 9/1994 | Germany . | |
| 4401097A1 | 7/1995 | Germany . | |
| 19608349 | 3/1996 | Germany . | |
| 0148012 | 6/1988 | Japan | 431/4 |

OTHER PUBLICATIONS

"Atomization and Sprays", A. Lefebvre, 1989, pp. 105–107, 238–241.

*Primary Examiner*—Ira S. Lazarus
*Assistant Examiner*—David Lee
*Attorney, Agent, or Firm*—Burns, Doane, Swecker & Mathis, L.L.P.

[57] ABSTRACT

The object of the invention is to provide a method and a device for operating a premix burner which improve the supply of fuel under certain types of operation.

According to the invention, this is achieved by the fact that the liquid fuel (2) and the water (27) are conveyed separately to the liquid-fuel nozzle (17), and only there a liquid-fuel/water mixture (28) is produced, which is then injected into the inner chamber (9) of the premix burner (4) in a plain jet (29) with an injection angle a of less than 10°. To this end and, the liquid-fuel nozzle (17), which opens out centrally into the inner chamber (9), is designed with a simple injection opening (19). A mixing zone (22), into which a liquid-fuel line (20) and a water feed line (21) open out, is arranged upstream of the injection opening (19).

14 Claims, 3 Drawing Sheets

METHOD AND DEVICE FOR OPERATING A PREMIX BURNER

BACKGROUND OF THE INVENTION

1. Field of the Invention

The invention relates to a method and a device for operating a premix burner.

2. Discussion of Background

Combustion chambers with premix burners which are designed as so-called double-cone burners and in which the fuel is supplied from the outside by plug-in fuel lances have long proven suitable for stationary gas turbines in power plants. The lance is generally configured as a two-fuel lance, i.e. it is possible, as desired, to supply gaseous fuel, e.g. pilot gas, and/or liquid fuel, for example an oil/water emulsion. To this end, a liquid-fuel pipe, an atomizer pipe and a pilot-gas pipe are arranged concentrically in the lance. The pipes each form a duct for the liquid fuel, the atomizer air and the pilot gas, which ducts, at the lance head, end in a fuel nozzle. The head of the fuel lance projects into a corresponding inner pipe of the double-cone burner, so that the fuel emerging passes via the fuel nozzle into the burner inner chamber which adjoins the inner pipe (cf. DE 43 06 956 A1).

EP 0,321,809 B1 has also disclosed a double-cone burner which is provided for use in a combustion chamber which is connected to a gas turbine. This burner comprises two hollow part-cone bodies which complement one another to form the double-cone burner and are arranged radially offset with respect to one another. It has a hollow-cone-shaped inner chamber which increases in size in the direction of flow and has tangential air-inlet slots. The fuel is supplied to the double-cone burner from the outside via the plug-in fuel lance which opens out into a liquid-fuel nozzle. The latter forms a hollow-cone-shaped fuel spray, consisting of liquid fuel and air, in the burner inner chamber, in which spray most of the fuel droplets are concentrated at the outer end of the conical spray pattern. Owing to the large spray angle of approx. 30° and the absence of an axial impulse in the center, these sprays are highly susceptible to centrifugal forces which are generated by the turbulent flow in the interior of the burner. As a result, the fuel droplets are carried relatively quickly outward by centrifugal forces, resulting, under certain operating conditions, in a not insignificant quantity of the liquid fuel striking the inner walls of the burner.

So-called plain jet orifices for the atomization of liquid fuels are known from the text book "Atomization and sprays" by A. Lefebvre, West Lafayette, Ind. 1989, pp. 106/107, 238–240. In such atomizer nozzles, the liquid fuel is ejected, at high pressure and with a cone angle of from 5 to 15°, from an antechamber through at least one circular injection opening of a defined guide length. The disintegration of the fuel jet into individual drops is promoted at a high flow velocity, since as a result both the level of turbulence in the jet flowing out and the aerodynamic tensile forces exerted by the surrounding medium increase. The plain jet orifice described likewise injects the liquid fuel together with the water, so that the abovementioned problems with fuel distribution may equally well occur.

SUMMARY OF THE INVENTION

The invention aims to avoid all these drawbacks. Accordingly, one object of the invention is to provide a method and a device for operating a premix burner which improve the supply of fuel under certain types of operation.

According to the invention, this is achieved by the fact that, in a method in accordance with the preamble of claim 1, the liquid fuel and the water are guided separately to the liquid-fuel nozzle and are mixed only in the liquid-fuel nozzle. The liquid-fuel/water mixture formed is then injected into the inner chamber of the premix burner in a plain jet with an injection angle $\alpha$ of less than 10°. For this purpose, the liquid-fuel nozzle is equipped with a simple injection opening. A mixing zone, into which both a liquid-fuel line and a water feed line open out, is arranged upstream of the injection opening. The liquid-fuel line and the water feed line are together arranged in a fuel lance, the latter having an end piece which forms the liquid-fuel nozzle. Both the injection opening and the mixing zone are arranged in this end piece of the fuel lance.

Owing to the pressure drop in the end piece of the fuel lance, the liquid fuel and the water, as well as their corresponding feed lines, remain separate from one another right up to the mixing zone, i.e. until shortly before the formation of the liquid-fuel/water mixture. This ensures satisfactory flow control, and as a result virtually the entire pressure drop available can be used to inject the fluids involved through the liquid-fuel nozzle. In this way, the liquid fuel is injected at a high speed and independently of the injection of the water, with the result that better atomization becomes possible. Moreover, the liquid-fuel/water mixture which is formed in the mixing zone cannot penetrate upstream into the liquid-fuel line or the water feed line, thus preventing flashback of the flame.

In a first embodiment of the invention, the water is introduced into the liquid fuel. For this purpose, the water feed line is formed radially outside the liquid-fuel line and coaxially with respect to the latter. The mixing zone is separated from the liquid-fuel line by means of a plate, the plate having at least one axial connection opening between liquid-fuel line and mixing zone and the water feed line having at least one radial passage opening to the mixing zone. The mixing zone advantageously has a transition piece, which is of funnel-like design, leading to the injection opening, with the result that it is possible to feed the liquid-fuel/water mixture to the injection opening under favorable flow conditions. It is particularly expedient if the water is introduced perpendicularly into the liquid fuel. In this way, it is possible to form a substantially homogeneous mixture within a relatively short mixing zone.

In a second embodiment of the invention, alternatively either the liquid-fuel line is arranged so as to open axially into the mixing zone and the water feed line is arranged so as to open conically into the mixing zone, or the water feed line is arranged so as to open axially into the mixing zone and the liquid-fuel line is arranged so as to open conically into the mixing zone. Therefore, depending on the configuration of the fuel lance, in order to prepare the liquid-fuel/water mixture either the water is introduced into the liquid fuel or the liquid fuel is introduced into the water. In this way, a pressure drop at the transition to the mixing zone can be prevented, so that the entire pressure drop available can be used, via the injection opening, to inject the liquid-fuel/water mixture into the interior of the premix burner. An injection of the liquid fuel and the water into the mixing zone at high speed results in considerable turbulence in that zone, thus promoting rapid and successful mixing of the two fluids.

Finally, the injection opening has a guide length l and a diameter d, with a guide length to diameter ratio of $2 \leqq l/d \leqq 20$ being adhered to. Such a ratio makes it possible to atomize the fuel mixture particularly successfully.

In a further refinement of the invention, the plain jet, which widens out in the direction of flow in the inner chamber of the premix burner and consists of the liquid-fuel/water mixture, is surrounded by a rotating combustion-air flow which flows tangentially into the burner. The ignition of the combustion mixture which is formed takes place in the region of the burner mouth, the flame front being stabilized in this region by a back-flow zone. For this purpose, the premix burner comprises at least two hollow part-cone bodies which are arranged radially offset with respect to one another and have tangential air-inlet slots and a hollow-cone-shaped inner chamber which increases in size in the direction of flow. The liquid-fuel nozzle is likewise connected to a fuel lance which serves to supply the fuel.

In particular, this method provides a shape of liquid spray with a small injection angle which interacts optimally with the small opening angle of the premix burner. As a result, ideal conditions for the combustion of liquid fuel are created by means of a premix burner designed in this way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which illustrate a plurality of exemplary embodiments of the invention with reference to a premix burner, which is installed in the combustion chamber of a gas turbine installation, having a liquid-fuel nozzle according to the invention. In the drawings.

Only those components which are essential to gain an understanding of the invention are shown. Components of the gas turbine installation which are not illustrated are, for example, the compressor and the gas turbine. The direction of flow of the working media is indicated by arrows.

DESCRIPTION OF THE PREFERRED EMBODIMENTS

Figure 1:
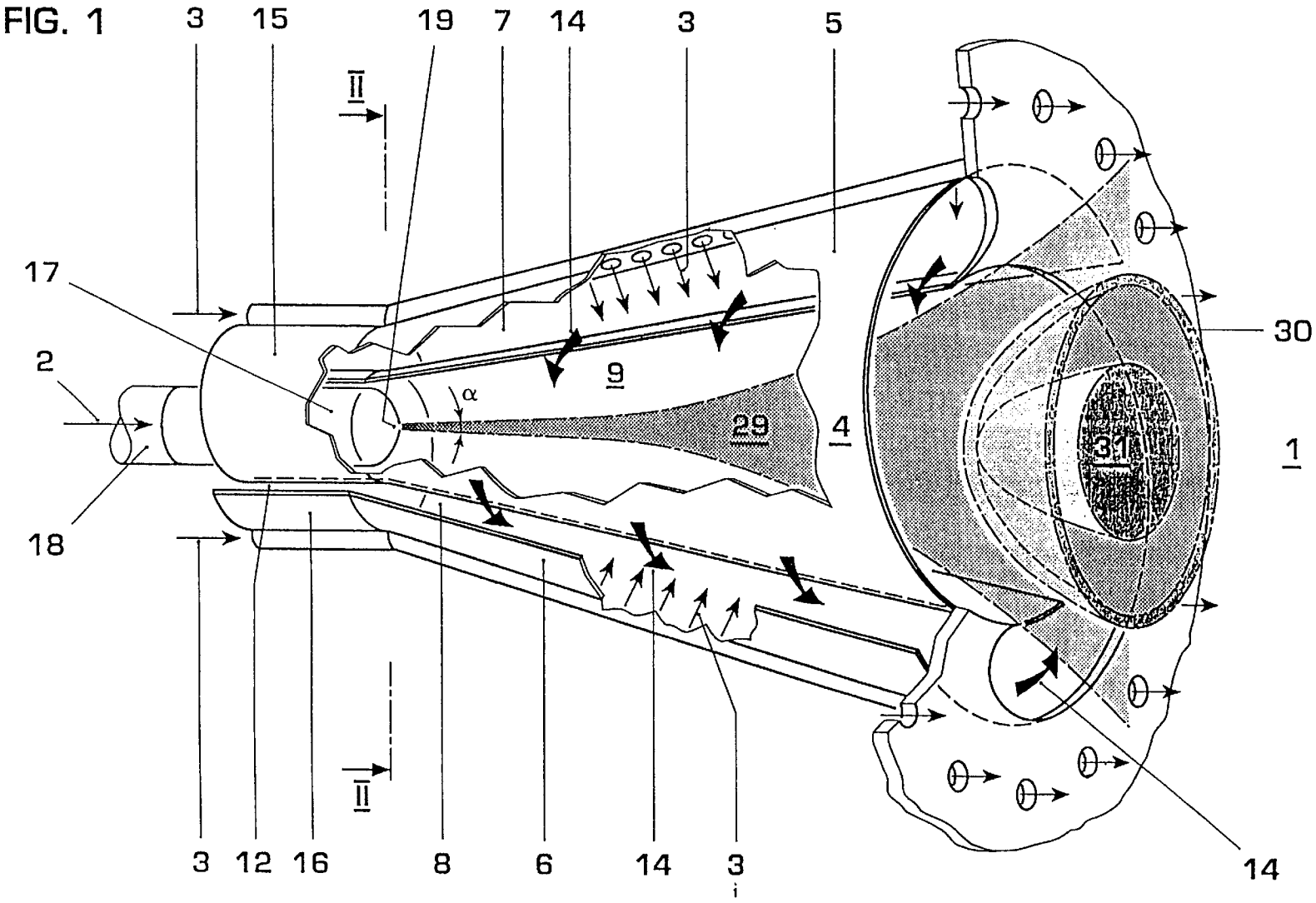
FIG. 1 shows a longitudinal section through a premix burner.
Figure 2:
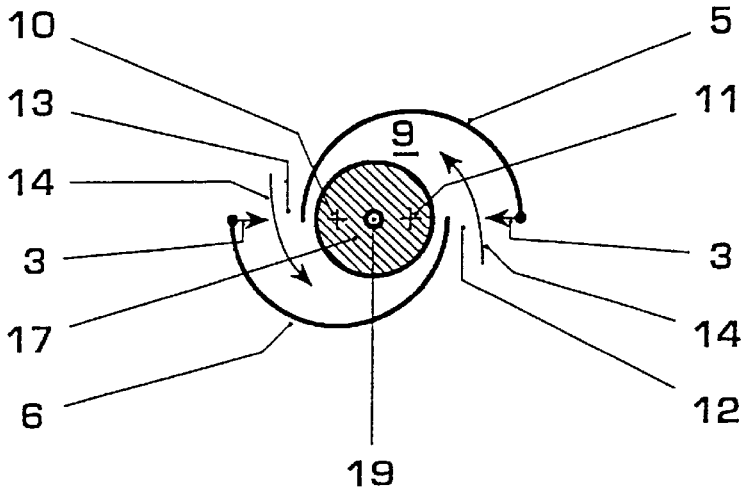
FIG. 2 shows a section through the premix burner on the line of the arrows II—II in FIG. 1.

Referring now to the drawings, wherein like reference numerals designate identical or corresponding parts throughout the several views, the gas turbine installation (not shown) comprises a compressor, a gas turbine and a combustion chamber 1. A plurality of premix burners 4, which are suitable for operation with liquid fuel 2 and with gaseous fuel 3 and are designed as double-cone burners, are arranged in the combustion chamber 1. The double-cone burners 4 in each case comprise two half, hollow part-cone bodies 5, 6, each with an inner wall 7, 8. The two inner walls 7, 8 enclose a hollow-cone-shaped inner chamber 9 which increases in size in the direction of flow (FIG. 1). The part-cone bodies 5, 6 each have a center axis 10, 11 which is arranged offset with respect to the other center axis (FIG. 2). As a result, they lie radially offset with respect to one another, one above the other, and form a tangential air-inlet slot 12, 13 on both sides of the double-cone burner 4, through which slot combustion air 14 flows into the inner chamber 9. The two part-cone bodies 5, 6 each have a cylindrical initial part 15, 16. The initial parts 15, 16 are, like the part-cone bodies 5, 6, arranged offset with respect to one another (FIG. 1). An end piece, which is designed as a central liquid-fuel nozzle 17, of a fuel lance 18, which serves to supply fuel to the double-cone burner 4, is arranged so as to project into the initial parts 15, 16 and into the inner chamber 9. The liquid-fuel nozzle 17 has a circular injection opening 19 (FIG. 2).

Figure 3:
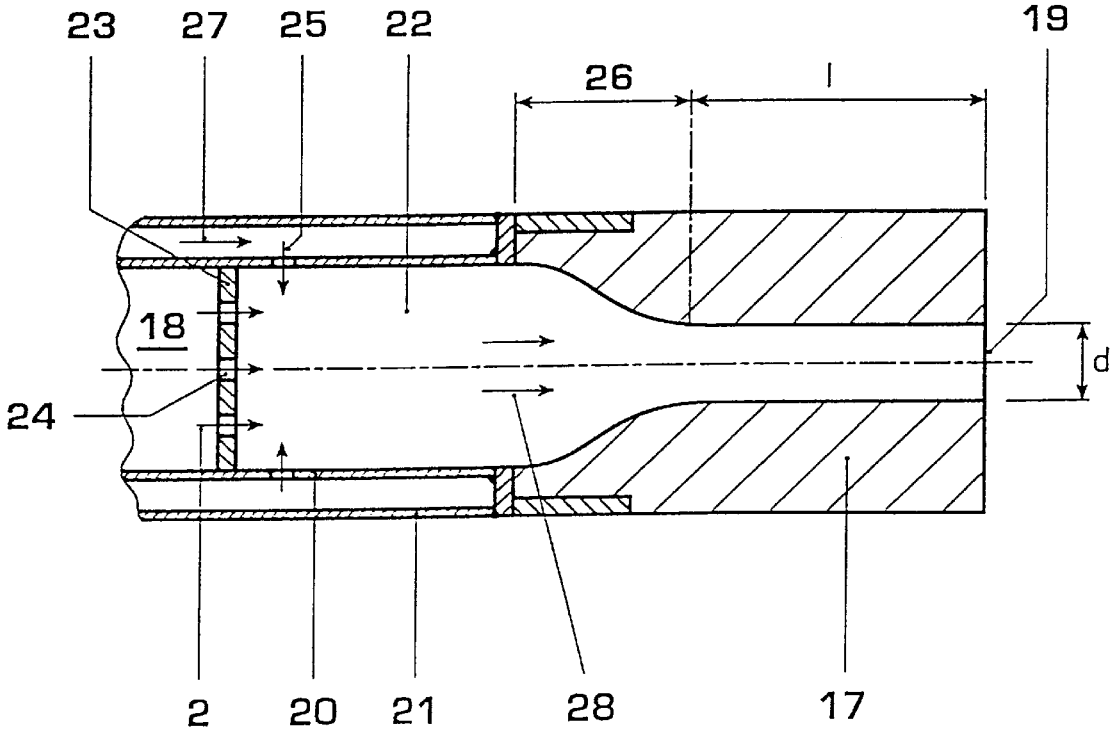
FIG. 3 shows an enlarged excerpt from FIG. 1, in the region of the liquid-fuel nozzle.

In a first exemplary embodiment, the fuel lance 18 comprises a central liquid-fuel line 20 and a water feed line 21 which is arranged radially outside the latter and coaxially with respect to the latter. A mixing zone 22 is formed upstream of the injection opening 19 and separated from the liquid-fuel line 20 by means of a vertically disposed, circular plate 23. The plate 23 has a plurality of axial connection openings 24 between the liquid-fuel line 20 and the mixing zone 22 and the water feed line 21 has a plurality of radial passage openings 25 leading to the mixing zone 22. The mixing zone 22 has a transition piece 26, which is of funnel-like design, leading to the injection opening 19. The latter has a guide length l and a diameter d and a guide length to diameter ratio of 4 (FIG. 3).

The double-cone burner 4 is supplied with fuel oil, which is used as the liquid fuel 2, via the liquid-fuel line 20 and with water 27 via the water feed line 21. The fuel oil 2 and the water 27 are conveyed separately to the liquid-fuel nozzle 17. Fuel oil 2 and water 27 are mixed only in the mixing zone 22 by the water 27 being injected perpendicularly into the fuel oil 2. However, since in this case fuel oil is used as the liquid fuel 2, it is not a true mixture which is formed, but rather a liquid-fuel/water emulsion 28. The liquid-fuel/water emulsion 28 is injected into the inner chamber 9 through the central injection opening 19 with an injection angle $\alpha$ of less than 10° (FIG. 1). Owing to this narrow injection angle, a plain jet 29, which is initially very compact, only opens out downstream and in which the fuel droplets are uniformly distributed across the entire cross section, is formed in the inner chamber 9 of the double-cone burner 4. In contrast to the hollow-cone-shaped fuel spray which is used in double-cone burners of the prior art, however, such a plain jet 29 has sufficient axial impulses in its center for the fuel droplets not to be carried onto the inner walls 7, 8 of the part-cone bodies 5, 6. In addition, this effect can be intensified further by a relatively high injection speed of the fuel oil 2 and the water 27. If a water-miscible liquid fuel 2 is used, as is also possible, of course, it is not an emulsion of liquid fuel 2 and water 27 which is formed in the mixing zone 22, but rather a corresponding liquid-fuel/water mixture 28.

The plain jet 29 widens out uniformly in the direction of flow in the inner chamber 9 of the double-cone burner 4 and thus ultimately assumes the form of a cone. The plain jet 29 is surrounded by the rotating combustion air 14 which flows in through the tangential air-inlet slots 12, 13. The fuel mixture formed is ignited in the region of the burner mouth, producing a flame front 30 which for its part is stabilized in the region of the burner mouth by a back-flow zone 31.

Figure 4:
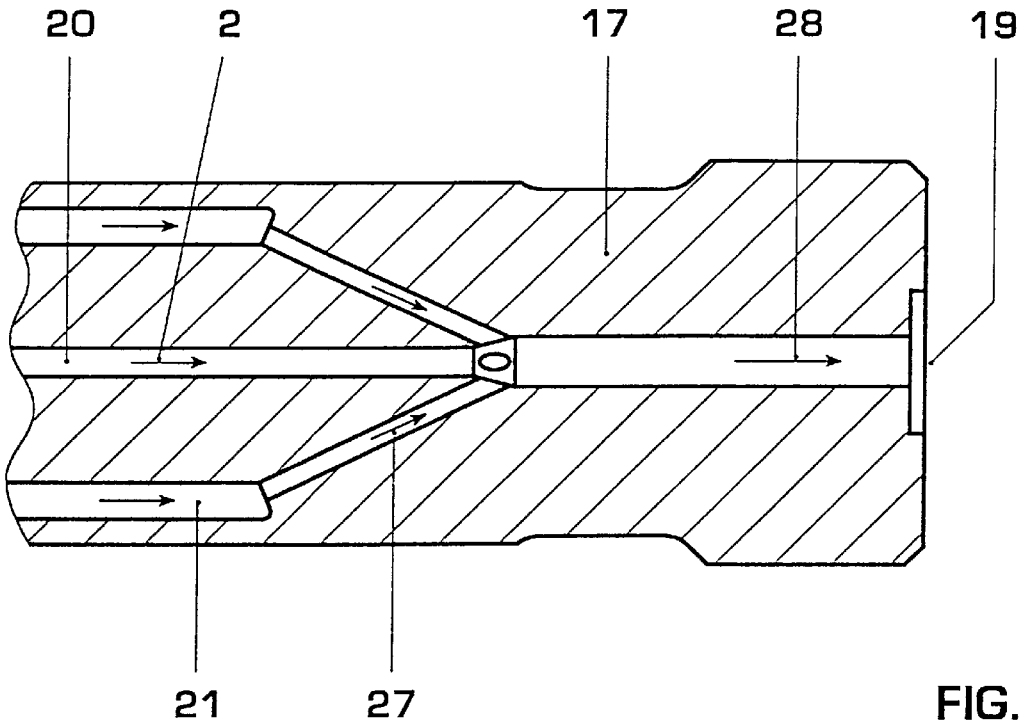
FIG. 4 shows an illustration in accordance with FIG. 3, but in a second exemplary embodiment.

In a second exemplary embodiment, a quotient of the guide length to the diameter of the injection opening of l/d=10 is reached, with the result that the turbulence which is inherent to the liquid-fuel/water emulsion 28 is calmed. In addition, the liquid-fuel line 20 is arranged so as to open axially into the mixing zone 22 and the water feed line 21 is arranged so as to open conically into the mixing zone 22 (FIG. 4). As a result, the water 27 is introduced into the liquid fuel 2 at an angle, so that it is possible to prevent a pressure drop at the transition to the mixing zone 22. Consequently, the entire pressure drop available is utilized, via the injection opening 19, to inject the liquid-fuel/water emulsion 28 into the inner chamber 9 of the premix burner 4, resulting in a small injection angle and hence a plain jet 29. All the further processes proceed in a similar manner to the first exemplary embodiment.

Figure 5:
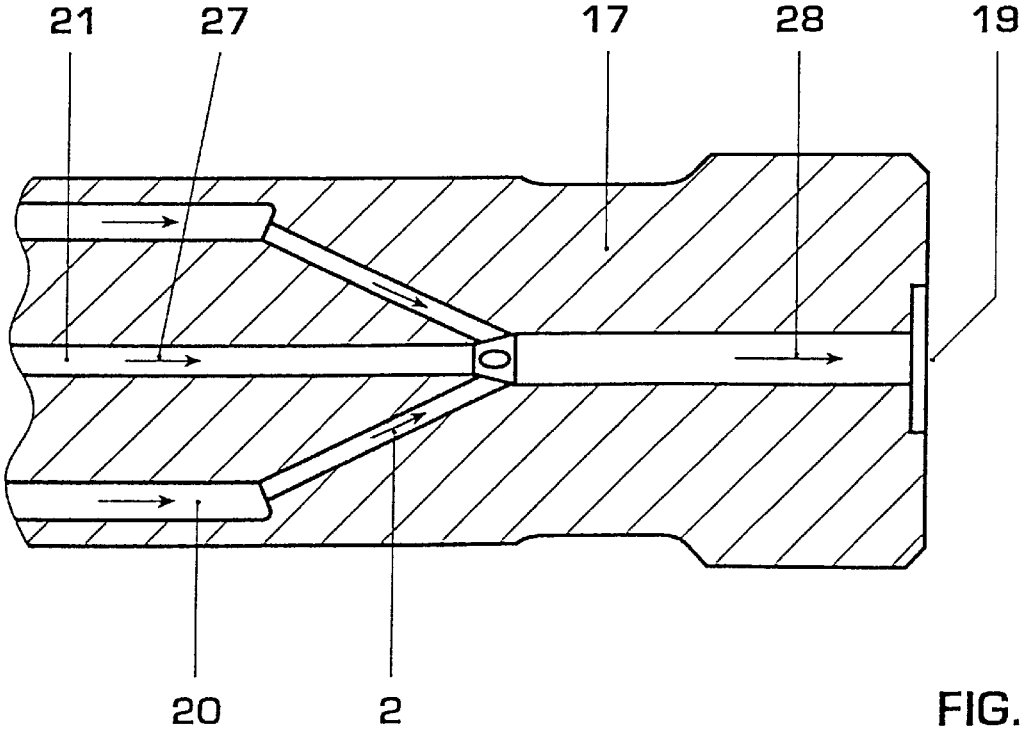
FIG. 5 shows an illustration of the premix burner corresponding to FIG. 4, but in accordance with a further exemplary embodiment.

In a further exemplary embodiment, an alternative solution which has essentially the same effects is illustrated, in which solution all that is changed by comparison with the second exemplary embodiment is that the arrangement of the liquid-fuel line 20 and of the water feed line 21 in the fuel lance 18 is changed round (FIG. 5). As a result, it is possible to achieve better atomization when operating without water 27.

Naturally, the injection opening 19, depending on the actual conditions of use of the double-cone burner 4, may also have some other suitable shape and the said quotient of guide length l and diameter d may be different, for example from 2 to 20. Of course, the double-cone burner 4 may be of purely conical design, i.e. without the cylindrical initial parts 15, 16.

Obviously, numerous modifications and variations of the present invention are possible in light of the above teachings. It is therefore to be understood that within the scope of the appended claims, the invention may be practiced otherwise than specifically described herein.

What is claimed as new and desired to be secured by Letters Patent of the United States is:

1. A method for operating a premix burner with liquid fuel and water, the premix burner having an inner chamber and a liquid-fuel nozzle which opens out centrally into the latter, comprising the steps of:

conveying the liquid fuel and the water separately to the liquid-fuel nozzle;

mixing the liquid fuel and water in the liquid-fuel nozzle to form a liquid-fuel/water mixture; and injecting the liquid-fuel/water mixture into the inner chamber of the premix burner in a plain jet with an injection angle of less than 10°.

2. The method as claimed in claim 1, wherein the water is introduced into the liquid fuel.

3. The method as claimed in claim 2, wherein the water is introduced perpendicularly into the liquid fuel.

4. The method as claimed in claim 1, wherein the liquid fuel is introduced into the water.

5. The method as claimed in claim 1, wherein the plain jet, which widens out in the direction of flow in the inner chamber of the premix burner, is surrounded by a rotating combustion air flow which flows tangentially into the premix burner, the mixture is ignited in the region of the burner mouth and the flame front is stabilized in this region by a back-flow zone.

6. A device for operating a premix burner with liquid fuel and water, comprising:

a) a premix burner having an inner chamber and a liquid-fuel nozzle, the liquid-fuel nozzle, which opens out centrally into the inner chamber, is equipped with a simple injection opening for injecting a liquid-fuel/water mixture in a plain jet with an injection angle of less than 10°;

b) a mixing zone is formed upstream of the injection opening in the liquid fuel nozzle, and c) a liquid-fuel line and a water feed line open out into the mixing zone.

7. The device as claimed in claim 6, wherein the liquid-fuel line and the water feed line are together arranged in a fuel lance, the fuel lance has an end piece which is designed as a liquid-fuel nozzle, and the injection opening and the mixing zone are arranged in this end piece.

8. The device as claimed in claim 7, wherein the water feed line is formed radially outside the liquid-fuel line and coaxially with respect to the latter, and the mixing zone is separated from the liquid-fuel line by means of a plate, the plate having at least one axial connection opening between liquid-fuel line and mixing zone and the water feed line having at least one radial passage opening to the mixing zone.

9. The device as claimed in claim 8, wherein the mixing zone has a transition piece, which is of funnel-like design, leading to the injection opening.

10. The device as claimed in claim 7, wherein the liquid-fuel line is arranged so as to open axially into the mixing zone and the water feed line is arranged so as to open conically into the mixing zone.

11. The device as claimed in claim 7, wherein the water feed line is arranged so as to open axially into the mixing zone and the liquid-fuel line is arranged so as to open conically into the mixing zone.

12. The device as claimed in claim 6, wherein the injection opening has a guide length and a diameter which are designed with a ratio of $2 \leqq l/d \leqq 20$.

13. The device as claimed in claim 6, wherein the premix burner comprises at least two hollow part-cone bodies, which are arranged radially offset with respect to one another, having a hollow-cone-shaped inner chamber which increases in size in the direction of flow, and the burner has tangential air-inlet slots and the liquid-fuel nozzle is connected to a fuel lance which serves to supply the fuel.

14. A device for operating a premix burner with liquid fuel and water, the premix burner having an inner chamber and a liquid-fuel nozzle, comprising:

means for conveying the liquid fuel and the water separately to the liquid-fuel nozzle;

means for mixing the liquid fuel and water in the liquid fuel nozzle to form a liquid-fuel/water mixture; and means for injecting the liquid-fuel/water mixture into the inner chamber of the premix burner in a plain jet with an injection angle of less than 10°.

* * * * *